United States Patent [19]

Mardikian

[11] Patent Number: 5,056,450

[45] Date of Patent: Oct. 15, 1991

[54] PERSONAL WATERCRAFT WITH EXTENDABLE HANDLEBAR

[76] Inventor: Albert A. Mardikian, 45 Goleta Point Dr., Corona del Mar, Calif. 92625

[21] Appl. No.: 455,632

[22] Filed: Dec. 22, 1989

[51] Int. Cl.[5] ..... B63H 25/46

[52] U.S. Cl. ..... 114/144 R; 114/270; 440/42

[58] Field of Search ..... 114/270, 144 R, 160; 440/40, 42, 62, 63; 74/480 B, 488, 493, 551.3

[56] References Cited

U.S. PATENT DOCUMENTS

| | | | |
|---|---|---|---|
| 1,367,695 | 2/1921 | Gray | 74/493 |
| 3,007,429 | 11/1961 | Sandman | 114/160 |
| 3,481,303 | 12/1969 | Tate et al. | 114/270 |
| 4,350,113 | 9/1982 | Moreau et al. | 114/270 |
| 4,941,421 | 7/1990 | Anderson | 114/144 R |

*Primary Examiner*—Sherman D. Basinger
*Attorney, Agent, or Firm*—Harold L. Jackson

[57] ABSTRACT

A personal watercraft having a selectively extendable and vertically pivotable steering set up is disclosed. The watercraft hull includes a channel for slidably receiving and engaging a steering arm to which a steering handlebar is mounted proximate one end and opposing protuberances formed proximate the opposite end. When the steering arm is fully extended retention means associated with the channel engage the protuberances so as to provide a pivotal connection. In an alternative embodiment the steering arm is selectively vertically rotatable and telescopically extendable.

10 Claims, 5 Drawing Sheets

10
12
14
16
18
20
22
28
30
32
36
38
38a
38b
38c
38d
50
70
72
74
76
80
82
83
8

PERSONAL WATERCRAFT WITH EXTENDABLE HANDLEBAR

BACKGROUND OF THE INVENTION

The present invention is directed to recreational watercraft having adjustable steering assemblies for convenient operation. The invention is particularly suited for personal watercraft where a range of operator positions from a seated to an upright stance can enhance watercraft performance and the recreational experience.

Personal watercraft typically employ a jet pump for generating a directed rearward stream of water which provides the forward thrust required to propel the craft and its occupants. The direction of propulsion is controlled by the positioning of a movable steering nozzle which receives the stream of water from the pump and directs the flow so as to divide the thrust into the desired directional components. The positioning of the nozzle is affected by a steering cable system connecting the nozzle to an operator handlebar. The handlebar typically includes a throttle control and an electrical on/off switch.

Personal watercraft have heretofore alternatively employed non-adjustable steering assemblies or handlebars mounted to a steering arm having an end pivotally connected to the hull for accommodating a range of vertical handlebar movement The pivotal arm better accommodates a standing rider position by substantially eliminating downward bending to reach the handlebars. Such pivotally fixed steering arms, however, limit handlebar positioning to a single degree of freedom along the circumference defined by the length of the steering arm. Further, an arm with a fixed pivot point, at higher vertical handlebar positions, requires the rider to assume a more forward stance than may be desired to maintain a comfortable handlebar grasp.

Therefore a need exists for a personal watercraft having a wider range of handlebar positioning so as to enhance the recreational experience and operational control of the watercraft by a rider.

SUMMARY OF THE INVENTION

The present invention enhances maneuverability and control of a personal watercraft by providing a pivotable steering arm which is extendable to better accommodate a desired stance and handlebar reach of a rider.

A preferred embodiment of such a watercraft comprises a hull having a channel for slidably receiving a steering arm segment. One end of the arm forms a protuberance which, when the arm is fully extended, mates with shackle means associated with the channel to form a pivotal connection.

An alternative embodiment of a personal watercraft according to the present invention comprises a pivotal steering arm which is simultaneously vertically rotatable and telescopically extendable and retractable. In either embodiment the handlebars can be repositioned within two degrees of freedom relative to the hull of the craft.

Accordingly, it is a principal object of the present invention to provide a personal watercraft having a steering control means which is selectively extendable and vertically rotatable so as to enhance the operational control and performance of the craft.

It is a related object of the present invention to provide additional steering control positioning freedom so as to enhance the recreational experience of the rider.

It is a further object of the present invention to provide pivotal steering control means which eliminates the need for a rider to assume an undesired forward stance at raised steering arm positions.

It is a yet further object of the present invention to provide a personal watercraft which can conveniently accommodate operation by riders of varying height and reach.

The foregoing and other objectives, features and advantages of the present invention will be more readily understood upon consideration of the following detailed description of the invention taken in conjunction with the accompanying drawings.

DESCRIPTION OF THE PREFERRED EMBODIMENT

Figure 1:
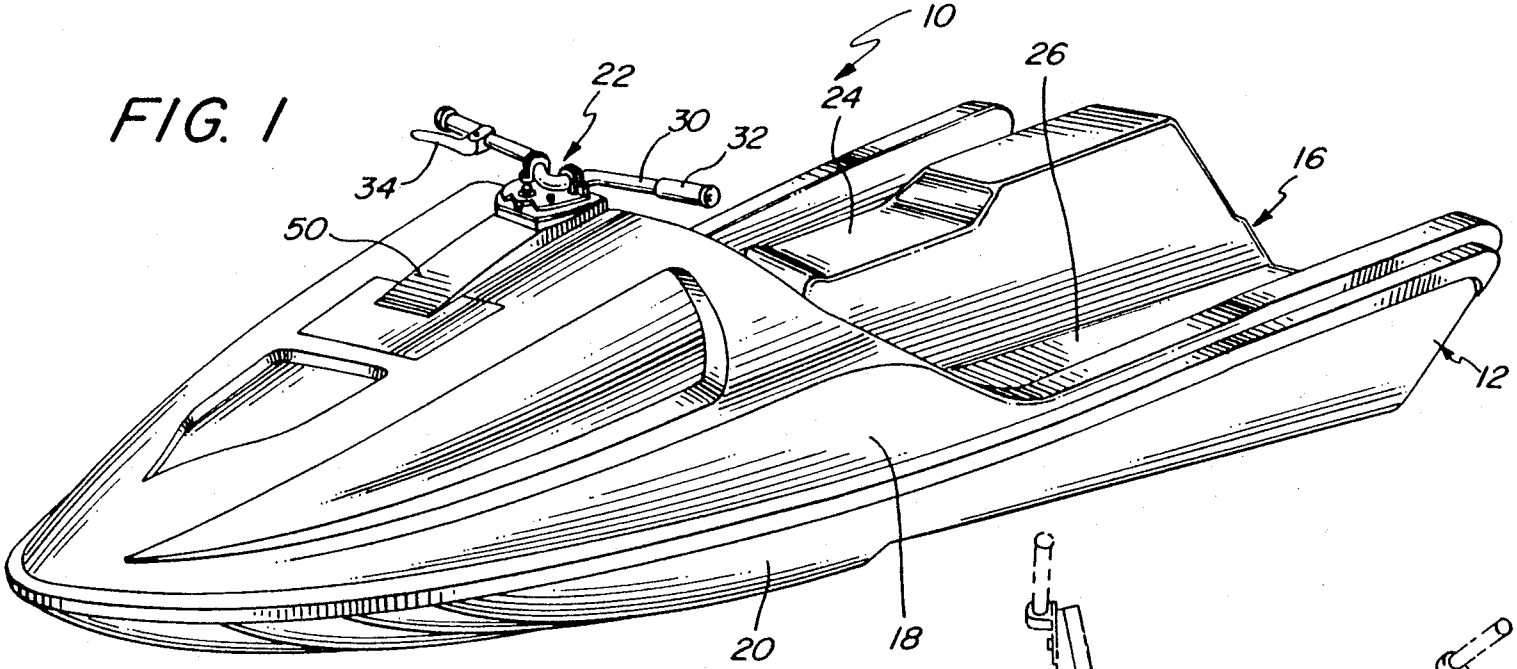
FIG. 1 is a front perspective view of an exemplary embodiment of a personal watercraft constructed in accordance with the present invention.
Figures 2, 10:
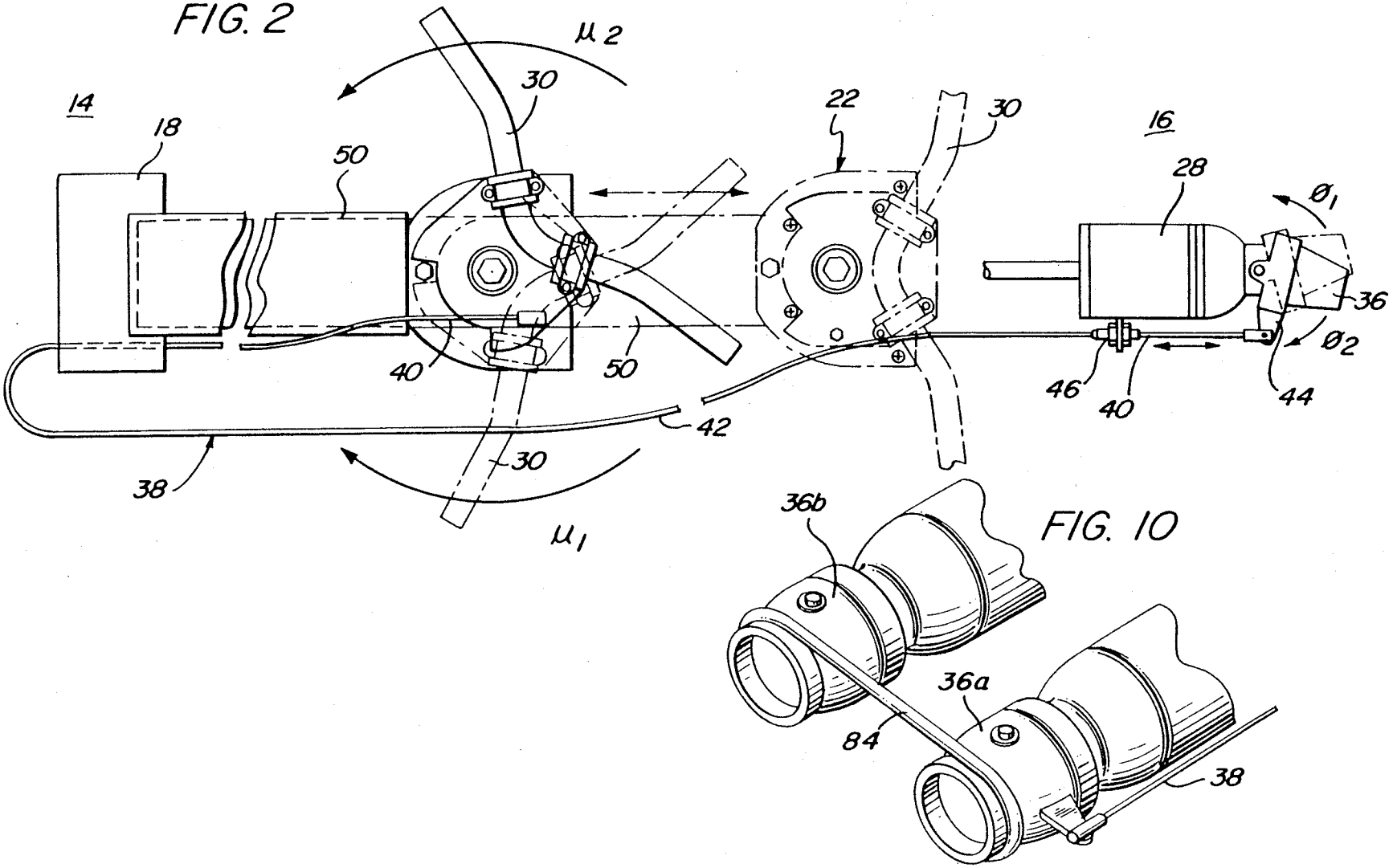
FIG. 2 is a schematic top view of the personal watercraft of FIG. 1.
FIG. 10 is a perspective view of a dual jet pump and steering control nozzle assembly in accordance with the present invention.
Figures 6, 7, 8:
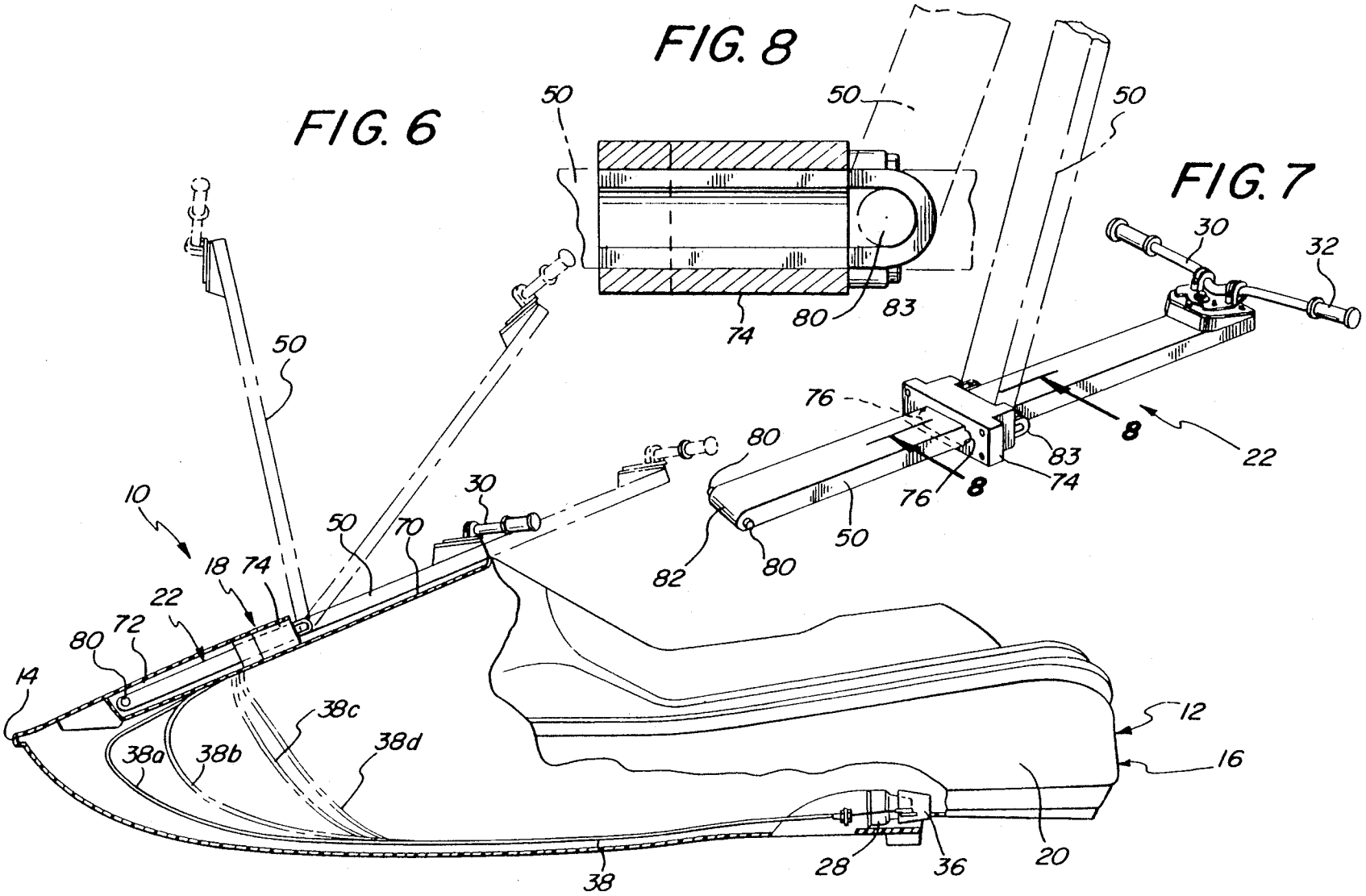
FIG. 6 is a partially cut away schematic side view of the personal watercraft of FIG. 1.
FIG. 7 is a front perspective view of a handlebar set-up constructed in accordance with the present invention.
FIG. 8 is a sectional view taken along lines 8—8 of FIG. 7.

Referring to FIG. 1, a preferred embodiment of the present invention is shown as comprising a personal watercraft 10 for recreational operation on the surface of a body of water. The watercraft includes a fiberglass hull 12 having an upper section 18 for supporting a rider and housing operational controls and a lower section 20 contoured to provide for maneuverability, stability and control within a wide range of speeds on water as disclosed for example in U.S. patent application Ser. No. 230,138 filed Aug. 9, 1988, now U.S. Pat. No. 4,932,347, the disclosure of which is hereby incorporated by reference. For reference, the hull 12 is horizontally divided into a bow section 14 and a stern section 16. The hull upper section 18 forms a passenger seat 24 and one or more substantially horizontal floor surfaces 26 for accommodating rider movement and a variety of stances. As best seen in FIGS. 2 and 6, a jet pump 28 for creating a high speed rearward flow of water to propel the jet ski 10 atop the water surface is secured to the lower hull section 20 proximate the stern 16. The jet pump 28 is powered by a marine engine, not shown, positioned within the hull 12 so as to achieve a desired center of gravity.

Referring again to FIG. 1, a handlebar steering control assembly 22 is mounted to the hull upper section 18, as will later be described in greater detail, toward the bow 14 of the craft. The handlebar 30 includes a pair of handgrips 32, a throttle control 34 and an electrical start/stop switch (not shown). The watercraft is steered, as shown in FIG. 2, by varying the angle at which the high speed flow of water is projected away from the stern section 16. This is accomplished by pivotally mounting a generally frusto-conical steering nozzle 36 for receiving and transmitting the rearward flow of water exiting the jet pump 28 through the constricted passageway formed by the nozzle 36 interior. The nozzle 36 is horizontally pivotable over an angle $\phi_1$, $\phi_2$ to obtain a desired range of steering control.

A steering cable 38 is employed to transmit a range of pivotal rotation $\mu_1$, $\mu_2$ of the handlebar 30 into the corresponding range of pivotal rotation $\phi_1$, $\phi_2$ of the steering nozzle 36. The cable 38 comprises an inner cable 40 axially slidable within a protective cable housing 42. The steering nozzle end of cable housing 42 is fixedly secured to the hull 12 proximate the nozzle 36. The entire length of the cable housing is also preferably secured to the hull at appropriate intervals using a plurality of wiring clamps so as to avoid kinking or other cable 38 entanglement which can interfere with the free axial movement of the inner cable 40. As will be further described herein, clockwise rotation $\mu_1$, of the handlebar 30 results in a counterclockwise directional rotation $\phi_1$ of the nozzle thereby executing a right directional turn of the watercraft 10. Similarly, counterclockwise rotation $\mu_2$ of the handlebar 30 results in a clockwise rotation $\phi_2$ of the nozzle thereby executing a leftward directional turn of the watercraft. Where both $\phi_1$, $\phi_2$ are zero, the steering nozzle is axially aligned with the longitudinal axis of the hull 12 thereby projecting the watercraft forward without a right or leftward directional component.

The steering nozzle 36 is positioned within its range of rotation by the axial movement of the inner cable 40. The nozzle end of the cable 40 is secured to a fixed lever arm 44 projecting radially outward from the nozzle in a direction substantially perpendicular to the axis of pivotal rotation of the steering nozzle. The angular displacement $\phi_1$ of the nozzle is accomplished when the inner cable is displaced rearward toward the stern 16 thereby forcing the lever arm 44 away from the end clamp 46. The nozzle is displaced along the angle $\phi_2$ when the inner cable is displaced forward toward the bow 14 thereby pulling the lever arm 44 toward the end clamp 46. The axial displacement of the inner cable 40 is accomplished by the connection of the opposite end of the inner cable 40 to the handlebar steering control assembly 22, as shown in FIGS. 3 and 4.

Figure 3:
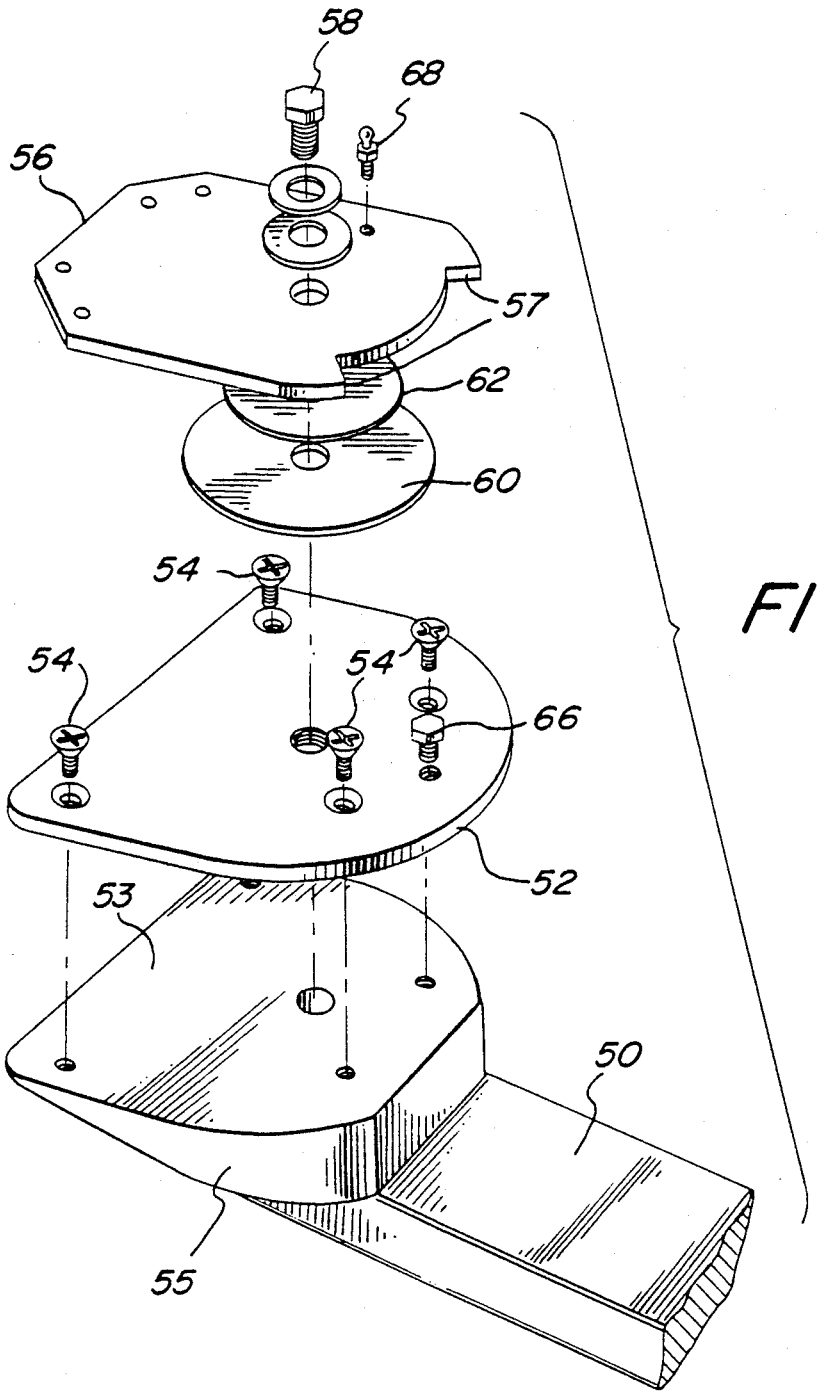
FIG. 3 is an enlarged, exploded view of a portion of the handlebar steering control assembly of the present invention.
Figure 4:
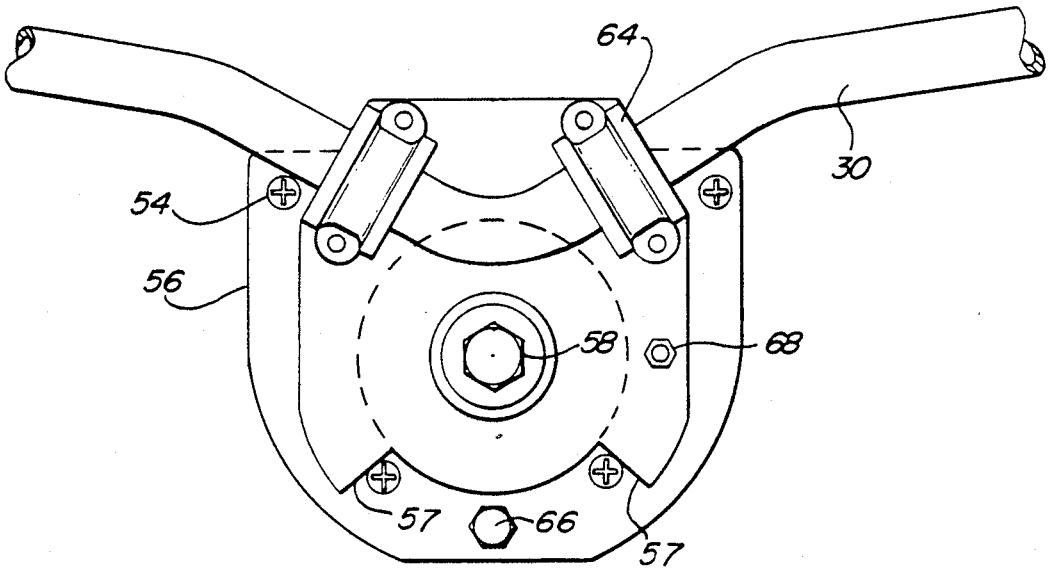
FIG. 4 is a top view of a handlebar steering control assembly constructed in accordance with the present invention.
Figure 5:
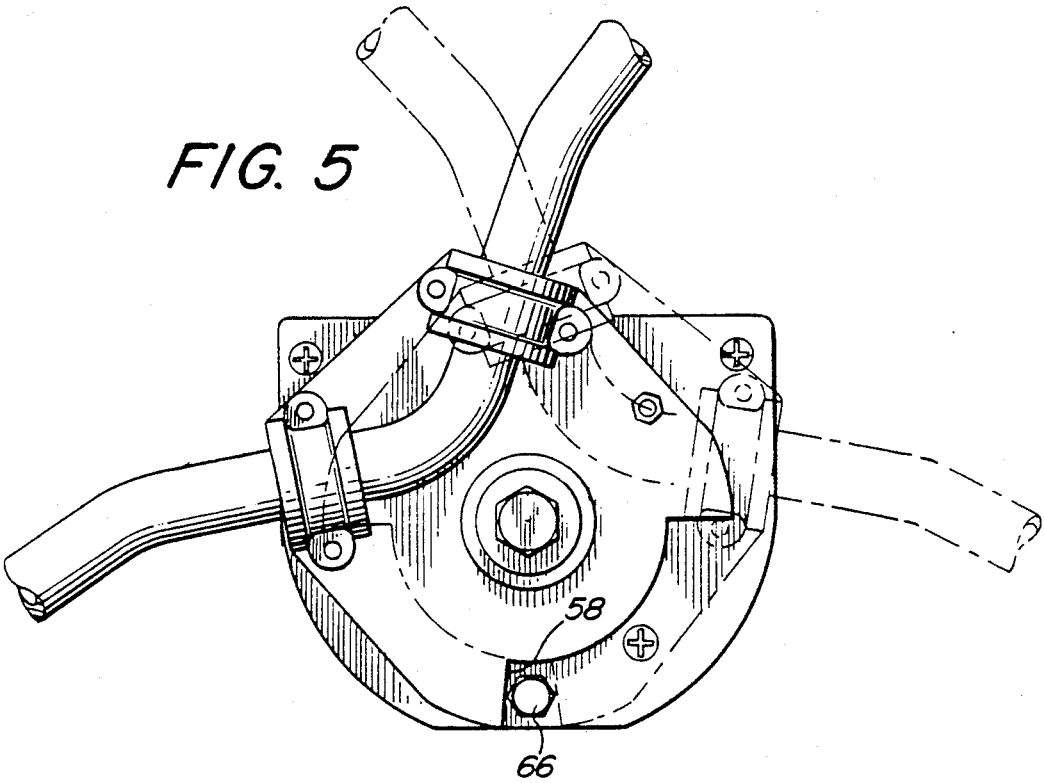
FIG. 5 is a top view of the handlebar steering control assembly of FIG. 4 showing alternative extreme handlebar positions.

Referring to FIG. 3, the steering assembly 22 is secured to the outer end of handle arm 50. An arm plate 52 is mounted to a planar end surface 53 atop a wedged shaped step 55 of arm 50 using flush set screws 54. A steering support bracket 56 is bolted atop plate 52 for pivotal rotation thereto using a pivot bolt 58 for mating threaded engagement with plate 52. A spacer 60 and bushing 62 are sandwiched between the plate 52 and bracket 56. As seen in FIG. 4, the handlebar 30 is secured to bracket 56 using U-clamps 64. A stop bolt 66 is secured to plate 52 and positioned intermediate a circumferential slot formed along the periphery of bracket 56 for engagement with opposing slot edges 57 of the bracket 56 so as to limit the range of rotation of the bracket, as best seen in FIG. 5. The end of cable 40 is secured to the bracket 56 using set screw 68. An end clamp, not shown, is preferably employed to fixedly secure the handlebar end of cable housing 42 to the arm 50. The segment of the cable 38, as well as the segments of other control lines, adjacent the handlebar 30, are preferably positioned inside the length of arm 50. As shown in FIG. 2, clockwise rotation $\mu_1$, of the handlebar displaces the inner cable 40 rearward toward the stern 16. Counterclockwise rotation $\mu_2$ of the handlebar draws the cable forward toward the bow 14.

The handlebar steering control assembly 22 is mounted to the hull 12 so as to be selectively extendable and vertically rotatable as shown in FIGS. 6, 7 and 8. The hull upper section 18 forms a channel 72 for slidably receiving the arm 50 and accommodating arm extension and retraction and forms an open recess 70 for accommodating arm rotation when the arm is fully extended. The assembly 22 includes a collar 74 slidably engaged to the arm 50. The collar 74 is secured to the hull proximate the opening of channel 72 to recess 70 The collar includes a pair of opposing tracts 76 for slidable engagement with mating dowels 80 proximate the arm end 82. The outer ends of tracks 76 are each closed by a respective clevis 83 secured to the collar 74. When so assembled the arm 50 is partially retracted into channel 72 a distance necessary to accommodate a desired rider seated position. When an upright stance is desired by the rider, the arm is extended so as to simultaneously position the projecting dowels 80 in a respective clevis 83. The projection of tracts 76 formed by each clevis 83 from collar 74 provides a clearance for pivotal rotation of arm 50 by the rider when extending the handlebars vertically to a desired height. The end 82 of arm 50 is rounded for further clearance when extended from the collar 74. The steering cable 38 is of sufficient length as to accommodate the extension of arm 50, as shown in FIG. 6 by exemplary cable positions **38*a*, 38*b*, 38*c*, 38*d***.

Figure 9:
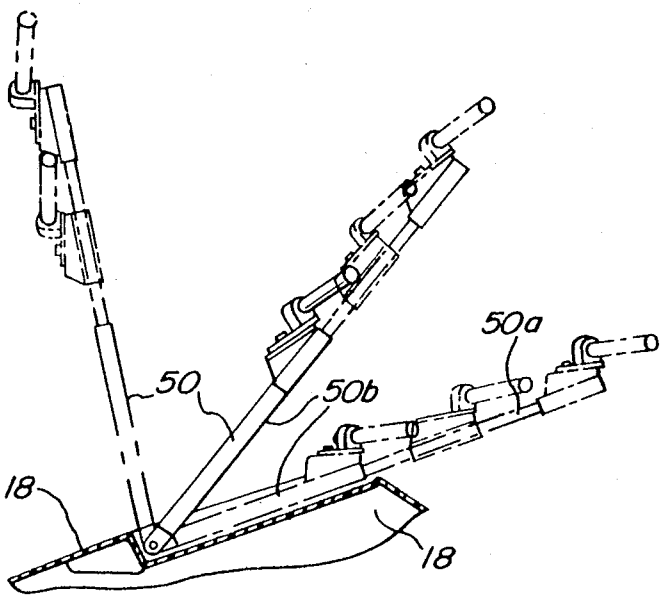
FIG. 9 is an exploded side view of an alternative embodiment of a handlebar set-up in accordance with the present invention mounted to a personal watercraft.

In an alternative embodiment shown in FIG. 9, the arm 50 is secured to upper hull 18 in a fixed pivotable connection with the arm including one or more selectively telescoping segments **50*a* and 50*b***. The resulting combination provides a pivotable arm having a range of extension lengths thereby achieving further adjustability of handlebar positioning.

FIG. 10 illustrates an alternative dual personal watercraft nozzle configuration employing a yoke 84 for connecting nozzles **36*a*, 36*b* for operation in tandem with a single connection of cable 38**.

What is claimed is:

1. A personal watercraft for use by a rider in a sitting or standing position comprising:

a hull adapted for movement across a water surface;

at least one jet pump including a steerable nozzle secured to said hull for generating a rearward stream of water from the nozzle which provides forward thrust to propel the craft forward, the nozzle being pivotally mounted on the hull;

an elongated steering arm;

a handlebar rotatably mounted on one end of the steering arm;

means connected between the handlebar and the nozzle so that the nozzle will follow the rotation of the handlebar to thereby control the direction of movement of the hull; and securing means for attaching the end of the steering arm remote from the handlebar to the hull, the securing means and the steering arm being constructed and arranged so that the arm may be extended from a retracted position to a fully extended position relative to the hull through the application of force only to the handlebar by a rider while the hull is in motion, the securing means being further arranged so that the arm may be rotated vertically to accommodate a rider in a standing position only when the arm is in an extended position whereby the steering arm may be placed in a retracted position to accommodate the rider in a sitting position and in an extended and rotated position to accommodate the rider in a standing position.

2. The invention of claim 1 wherein the steering arm comprises a elongated member and the securing means comprises a collar mounted on the hull and surrounding the arm to permit the arm to freely slide within the collar to permit extension and retraction of the arm relative to the hull, the steering arm and collar being arranged to allow the arm to be pivoted in a vertical plane only when the arm is in a fully extended position.

3. A personal watercraft for use by a rider in a sitting or standing position comprising:

a hull adapted for movement across a water surface;

at least one jet pump including a steerable nozzle secured to said hull for generating a rearward stream of water from the nozzle which provides forward thrust to propel the craft forward, the nozzle being pivotally mounted relative to the hull;

an elongated steering arm;

a handlebar rotatably mounted on one end of the steering arm;

means connected between the handlebar and the nozzle so that the nozzle will follow the rotation of the handlebar to thereby control the direction of movement of the hull; and channel means secured to the hull for slidably receiving the end of the steering arm remote from the handle bar to permit the arm to be extended from or retracted into the channel means, the channel means and the steering arm being constructed and arranged so that the arm when fully extended relative to the channel means may be pivoted in a vertical plane to accommodate a rider in a standing position and when the arm is not in a fully extended position the arm is prevented from pivoting to accommodate a rider in a sitting or kneeling position.

4. The invention of claim 3 wherein;

the steering arm forms a protuberance proximate the end remote from the handlebar; and the channel means includes a track and a retention means operatively associated with the track for journaled engagement with the protuberance on the steering arm to limit the extension of the steering arm and permit rotation of the steering arm in the fully extended position.

5. The invention of claim 4 wherein the retention means is a clevis.

6. A personal watercraft for use by riders in a sitting or standing position comprising:

a hull adapted for movement across a water surface;

at least one jet pump including a steerable nozzle secured to said hull for generating a rearward stream of water from the nozzle which provides forward thrust to propel the craft forward, the nozzle being pivotally mounted relative to the hull;

an elongated steering arm having a first and second end;

steering control means mounted on the first end of the steering arm, the steering control means being moveable relative to the steering arm;

means connected between the steering control means and the nozzle so that the nozzle will follow the movement of the steering control means to thereby control the direction of movement of the hull;

securing means for attaching the second end of the steering arm to the hull; and the steering arm and the securing means being constructed and arranged so that the first end of the steering arm may be extended relative to the hull from a retracted position for accommodating a rider in a standing position and retracted relative to the hull for accommodating a rider in a sitting position, the steering arm and securing means being further arranged to allow the steering arm to rotate in a vertical plane when in the fully extended position and to prevent rotation of the steering arm when in the retracted position.

7. The invention of claim 6 wherein the steering control means comprises a handlebar rotatably mounted on the first end of the steering arm so that the direction of the nozzle is controlled by the rotation of the handlebar.

8. The invention of claim 7 wherein the securing means comprises a collar mounted on the hull for slidably receiving the steering arm.

9. The invention of claim 8 wherein the steering arm includes protrusions on the second end thereof and wherein the collar includes a pair of opposing tracts for slidably engaging the protrusion on the steering arm, the tracts being closed adjacent the end at when the steering arm exits to receive the protrusions when the steering arm is fully extended to permit the arm to be pivoted in the vertical plane.

10. The invention of claim 9 wherein the closed tracks on the collar form a clevis.

* * * * *

UNITED STATES PATENT AND TRADEMARK OFFICE

CERTIFICATE OF CORRECTION

PATENT NO. : 5,056,450

DATED : October 15, 1991

INVENTOR(S) : Albert A. Mardikian

It is certified that error appears in the above-identified patent and that said Letters Patent is hereby corrected as shown below:

Column 4, line 24, after "70" should be --.--.

Column 6, line 50, "when" should be --which--.

Signed and Sealed this

Ninth Day of March, 1993

*Attest:*

STEPHEN G. KUNIN

*Attesting Officer*

*Acting Commissioner of Patents and Trademarks*